United States Patent [19]

Wagener

[11] Patent Number: 4,942,507

[45] Date of Patent: Jul. 17, 1990

[54] REFLECTOR FOR DENTAL AND SURGICAL OPERATING ROOM LIGHTING FIXTURES

[75] Inventor: Harry Wagener, Alfeld/Leine, Fed. Rep. of Germany

[73] Assignee: AUER-SOG Glaswerke GmbH, Bad Gandersheim, Fed. Rep. of Germany

[21] Appl. No.: 338,540

[22] Filed: Apr. 14, 1989

Related U.S. Application Data

[63] Continuation-in-part of Ser. No. 119,510, Nov. 12, 1987, abandoned.

[30] Foreign Application Priority Data

Nov. 12, 1986 [DE] Fed. Rep. of Germany ..... 3638669

[51] Int. Cl.[5] ..... F21V 7/09

[52] U.S. Cl. ..... 362/296; 362/347; 362/348; 362/804

[58] Field of Search ..... 362/256, 341, 347, 348, 362/804

[56] References Cited

U.S. PATENT DOCUMENTS

| | | | |
|---|---|---|---|
| 3,191,023 | 6/1965 | Sullivan et al. | 362/220 |
| 3,511,983 | 5/1970 | Dorman | 362/217 |
| 4,149,227 | 4/1979 | Dorman | 362/297 |
| 4,234,247 | 11/1980 | Dorman | 362/804 |
| 4,242,727 | 12/1980 | DeVos et al. | 362/346 |
| 4,308,573 | 12/1981 | McNamara, Jr. | 362/349 |
| 4,456,948 | 6/1984 | Brun | 362/308 |
| 4,459,647 | 7/1984 | Yamauchi et al. | 362/297 |
| 4,488,207 | 12/1984 | Harmon | 362/231 |
| 4,517,630 | 5/1985 | Dieffenbach et al. | 362/339 |
| 4,697,225 | 9/1987 | Lindae et al. | 362/346 |
| 4,755,919 | 7/1988 | Lindae et al. | 362/346 |
| 4,772,987 | 9/1988 | Kretschmer et al. | 362/343 |

FOREIGN PATENT DOCUMENTS 2446521 10/1975 Fed. Rep. of Germany .

OTHER PUBLICATIONS

Holmes, J. G., "Para-Ellipsoid Mirrors and Fan shaped Beams," Lighting Research & Technology, vol. 11, No. 2, pp. 95-98 (1979).

*Primary Examiner*—Ira S. Lazarus
*Assistant Examiner*—Richard R. Cole
*Attorney, Agent, or Firm*—Millen, White & Zelano

[57] ABSTRACT

A reflector for dental and surgical operating room light fixtures exhibits, in a first cutting plane, an elliptic contour. A parabolic contour is exhibited in a second cutting plane vertical to this first cutting plane. The center of the lamp filament is in the common focal point of the ellipse and parabola. A fine light-diffusing structure overlies the light-reflecting surface to improve the uniformity of the light field.

6 Claims, 1 Drawing Sheet

REFLECTOR FOR DENTAL AND SURGICAL OPERATING ROOM LIGHTING FIXTURES

This application is a continuation-in-part of application Ser. No. 119,510, filed Nov. 12, 1987, now abandoned.

BACKGROUND OF THE INVENTION

The invention relates to a reflector for dental and surgical operating room lighting fixtures and the like.

The combination of ellipsoid and paraboloid (for example, DE No. 24 46 521, U.S. Pat. No. 3,191,023) reflectors in the case of the customary use of an elongated light source, especially an incandescent filament, in principle offers the possibility of producing an elongated light field in a desired working place spaced a distance from the light source. This represents a significant advantage in comparison with reflectors in the form of an ellipsoid section (U.S. Pat. Nos. 3,511,983, 4,149,227) or a paraboloid section (U.S. Pat. No. 4,459,647). However, it is difficult for the usual applications, for example, in the jaw area, to achieve a sufficiently great elongated light field and in it a desired uniform beam power density, specifically over a depth necessary for use (in the direction of the optical axis y=0, z=0 of the reflector). To approach this goal, it is known to modify the shape of the reflector. Thus, an ellipsoid reflector is known (U.S. Pat. No. 3,511,938), whose basic ellipsoid shape is overlaid with a plurality of convex or concave partial mirrors. Production of such a re lector is quite expensive. In another known ellipsoid reflector (U.S. Pat. No. 4,149,227), the ellipsoid is made up of strip-shaped segments that are twisted somewhat outward. This method of construction is also very expensive. The same applies for another known reflector (U.S. Pat. No. 4,459,647), which has the shape of a paraboloid section wherein the parabolic surface is made up of plane mirror segments.

Generally, the subdivision of the reflector into several partial surfaces has the drawback that it is not possible to deposit thin layers with uniform thickness by vapor. Thus, specially in the usual vapor deposition of thin reflecting layers, chromatic distortions occur within and especially on the edges of the light field. Finally, the assembly from partial surfaces in reflectors with the initially mentioned basic shape of an ellipsoid-paraboloid section is still more expensive than with simpler basic shapes.

In a known reflector of the initially indicated type (J. G. Holmes, Lighting Research and Technology, 1979, Volume 11, No. 2, pages 95–98), the ellipsoid-paraboloid basic shape in which a parabolic or elliptic shape is present in two axial planes perpendicular to one another, is formed in the transition areas between these axial planes so that all plane sections perpendicular to the ellipse plane are parabolas, and all beams that emerge from the closer ellipsoid focal point and the paraboloid focal point united with it, are reflected parallel to the ellipse plane and go through a focal line of the more distant ellipse focal point perpendicular to the ellipse plane. Thus, a wider light field containing the focal line can be illuminated only with very great irregularity of the beam power density. References to other possible intensity distributions are contained in this work, but only one of them corresponds to the effort to obtain a wider light field with uniform illumination; for this purpose, a double ellipsoid is proposed, which has different closer focal point distances in two axial sectional planes perpendicular to one another. It is clear that thus the ellipsoid paraboloid concept was abandoned.

SUMMARY OF THE INVENTION

An object of the invention is to provide a reflector suitable for operating room lighting fixtures and the like, a reflector that by itself produces an almost rectangular and largely uniformly illuminated light field.

In the reflector according to the invention the ellipsoid-paraboloid basic shape sought is distorted so that a desired approximately rectangular light field is more uniformly illuminated in the area of focal line corresponding to the basic shape. The distortion is continuously produced, so that neither edges or discontinuities nor the drawbacks caused by them need be accepted, and simple production is possible. Additional partial mirrors are not necessary but, of course, can be applied for special purposes.

For the production, it is especially favorable if the shape of the reflector is defined by a simple closed mathematical relation, which can easily be input into a production robot.

Upon further study of the specification and appended claims, further objects and advantages of this invention will become apparent to those skilled in the art.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DETAILED DESCRIPTION

Figure 1:
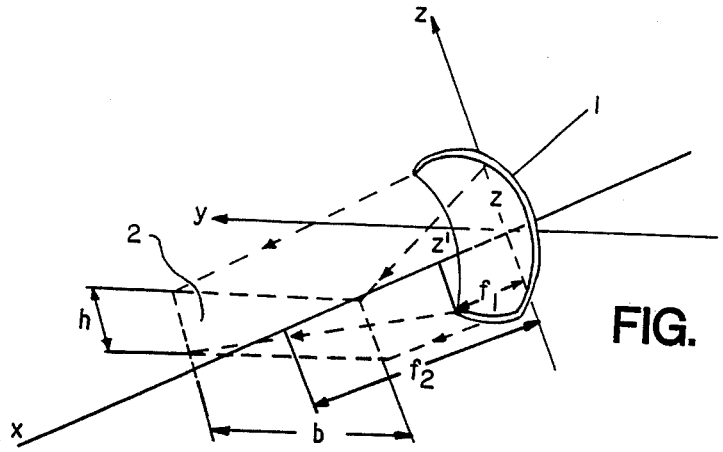
FIG. 1 is a perspective view of a reflector configured in accordance with the principles of the instant invention.

Let vertex Z of reflector 1 be at the origin of a Cartesian coordinate system with axes x, y and z (FIG. 1) In this case, the z axis extends in the vertical direction, while the x axis coincides with the optical axis. A rectangular light field 2 of height h and width b is to be produced in the plane $x=f_2$. Let center Z' of the lamp filament be at $f_1;0;0$.

The basic shape of reflector 1 can be clearly described by a three-dimensional equation for a spatially extended surface:

$$x = \frac{y^2}{2 \cdot p} + a \cdot \left(1 - \sqrt{1 - \frac{z^2}{b^2}}\right)$$

Figure 2:
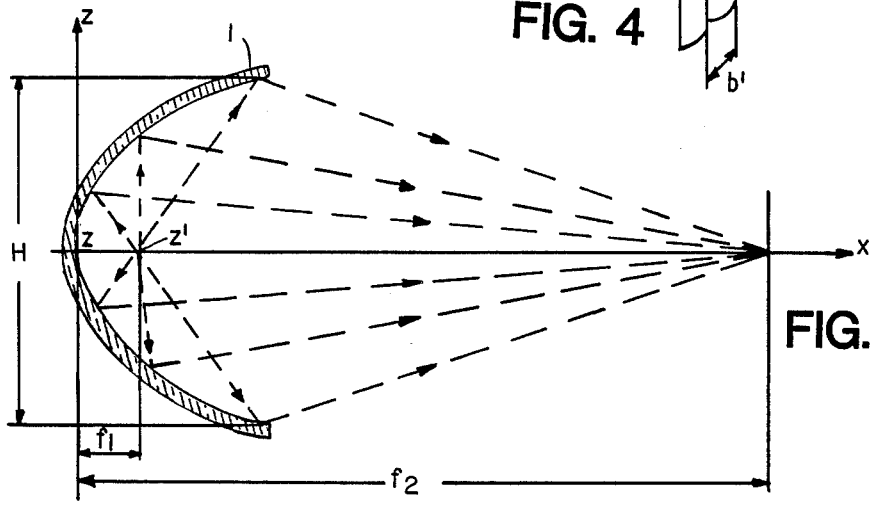
FIG. 2 is a side elevation of the reflector of FIG. 1 taken in a first cutting plane showing an ellipsoid cross section.

At the intersection with plane y=o, the two-dimensional curve results from it $$x = a \cdot \left(1 - \sqrt{1 - \frac{z^2}{b^2}}\right)$$

or $$\frac{(x-a)^2}{a^2} + \frac{z^2}{b^2} = 1 \qquad \text{(See FIG. 2.)}$$

This is the equation of an ellipse with long semiaxis a and short semiaxis b. The center of this ellipse is at a;0;0, their vertices are thus at 0;0;0 and 2a;0;0.

Semiaxes a and b are selected so that all light beams that come from point $f_1$;0;0 and fall on the ellipse unite at $f_2$;0;0. This is the case, if $$a = \frac{f_1 + f_2}{2}$$

and $$b = \sqrt{f_1 \cdot f_2}$$

Figure 3:
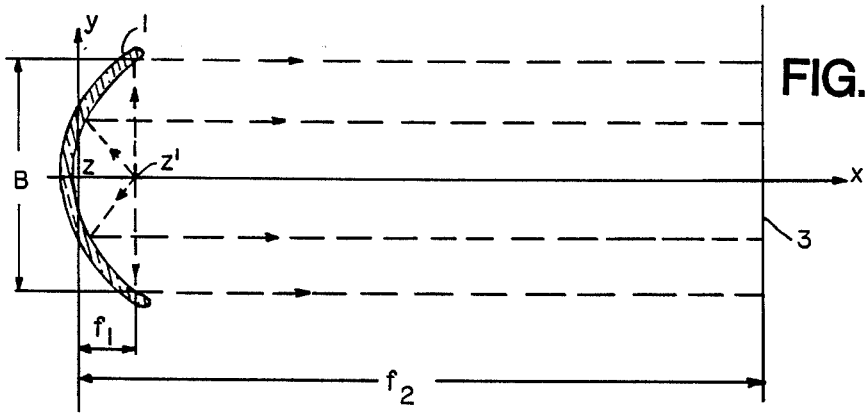
FIG. 3 is a side elevation of the reflector of FIG. 1 taken in a second cutting plane perpendicular to the first cutting plane showing a parabolic cross section.

On the other hand, rom the basic shape of the reflector at the intersection with the plane z=0, the curve results $$x = \frac{y^2}{2 \cdot p}$$

or $$y^2 = 2px \qquad \text{(See FIG. 3.)}$$

This is the equation of a parabola with parameter p, this parameter p is selected so that all light beams that come from point $f_1$;0;0 and fall on this parabola are reflected parallel to the optical axis. This is the case, if $$p = 2 \cdot f_1.$$

The basic shape of reflector 1 can thus be described as follows:

$$x = \frac{y^2}{4 \cdot f_1} + \frac{f_1 + f_2}{2} \cdot \left(1 - \sqrt{1 - \frac{z^2}{f_1 \cdot f_2}}\right)$$

All light beams that come from point $f_1$;0;0 and fall on reflector 1 in plane y=o and z=o combine in plane x=$f_2$ into a focal line 3 which extends parallel to the y axis and r which z =o. This focal line 3 is just as long as reflector 1 is wide, i.e., b=B .

All other light beams that strike reflector 1 outside planes y=o and z=o no longer combine exactly in this focal line 3. But this is advantageous for the reasons discussed as follows.

The real, not ideally small, lamp filament produces light beams whose source is more or less distant from point $f_1$;0;0. From that results a natural light diffusion. This is the greater, the more extended the lamp filament is or the closer lamp filament is to the surface of the reflector. Therefore, it is greatest for vertex Z of reflector 1 and becomes smaller the farther away the reflecting surface is from point $f_1$;0;0, i.e., from center Z' of the lamp filament. But there, the distortions of the parabolic ellipsoid are just strongest so that the two light-diffusing effects considerably overlap in a uniform basic diffusion over all reflector parts.

Further to this point, it is well known that there is always a natural scattering of light in real optical systems. This scattering is substantially proportional to the dimensions of the light source, i.e., the dimensions of the filament, and inversely proportional to the distance between the reflecting plane and the light source. Consequently, those areas of the reflector which are the greatest distance from the filament produce the smallest natural scattering of the image of the filament in the light field area at focal point $f_2$. This phenomenon becomes more pronounced as the distance of the reflector area from the three axes x, y and z increases. Consequently, these are the areas which produce the greatest "distortion" in the reflector of the instant invention. In other words, these areas reflect the light beam in such a way that it does not meet the light field plane on a caustic line along the y-axis, but rather strikes it at a certain distance therefrom so that the light being reflected from the off-axis reflector areas are scattered more in the z-direction. These small natural scatterings and greater distortions compensate one another, which results in a reflected image which is generally rectangular and uniform in intensity.

Thus, an almost rectangular light field 2 is produced, having a width b determined first by width B of the reflector and second by the length of the lamp filament in the y direction. Height h of light field 2 is essentially determined by the width of the lamp filament in the z direction, but further also by said distortions by the parabolic ellipsoid on its off-axis points.

Whenever a lamp filament has a wide helical winding and thus a very inhomogeneous light density distribution, that is manifested in the imaging properties of the reflector in a certain irregularity of the illumination in the light field, then it is advantageous if a slight light-diffusing structure is overlaid on the basic shape of the parabolic ellipsoid. Then, the regularity of the illumination of light field 2 is substantially improved without significantly enlarging the width and height of the light field.

In the cases in which a larger light field is desired, this can be obtained by a coarser light-diffusing structure.

Figure 4:
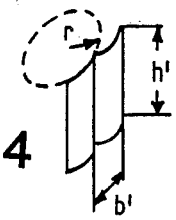
FIG. 4 is a perspective view schematically illustrating distortions being introduced into the reflector surface by a milling machine.

In any case, the overlaid light-diffusing structure, without additional operation, can be applied in a numerically controlled milling of the shaping tool for the parabolic ellipsoid (see FIG. 4). Selection of a suitable milling diameter of 2·r, automatically produces small lateral cylinder surfaces of radius r, whose width b' and height h' are formed by the respective step width in the numerically controlled milling operation.

In a reflector 1 having the dimensions x=75, y=150, $f_2$=760, $f_1$ (FIG. 2)=46.2, $f_1$ (FIG. 3)=46.9; the values for a coarser light-diffusing structure of the radius r, width b' and height h' are approximately r=20, h'=4–8 and b'=1 and for a slight light-diffusing structure the values are r=40, h'=2–4 and b'=1.

An enlargement of the width and height of the light field is also obtained if center Z' of the lamp filament is shifted from point $f_1$;0;0 in the direction of the reflector. The same effect is obtained if semiaxes a and b of the ellipse and parameter p of parabola are calculated as follows;

$$a = \tfrac{1}{2}(f_2 + f')$$

-continued $$b = \sqrt{f_2 \cdot f'}$$

$$p = 2 \cdot f'$$

with $f' > f_1$
and with lamp center Z' at $f_1;0;0$.

If only width b of light field 2 is to be enlarged, the following is selected;

$$a = \tfrac{1}{2}(f_2 + f_2)$$

$$b = \sqrt{f_1 \cdot f_2}$$

$$p = 2 \cdot f'$$

with $f' > f_1$
and lamp center Z' at $f_1;0;0$.

On the other hand, if $f' < f_1$ is selected, with lamp center Z' at $f_1;0;0$ light field b becomes smaller than reflector width B.

Finally, if only height h of light field 2 is to be enlarged, the calculation is made $$a = \tfrac{1}{2}(f_2 + f')$$

$$b = \sqrt{f_2 \cdot f'}$$

$$p = 2 \cdot f_1$$

with $f' > f_1$ and lamp center Z' at $f_1;0;0$.

From the above considerations, it is evident that the focal point of the ellipse and the focal point of the parabola intersect the x-axis an insignificant distance from one another, that distance, however, determines the width of the light field. Corrrespondingly, the focal point of the ellipse and the focal point of the parabola can be spaced an insignificant distance from one another on the y-axis, that distance determining the length of the light field. Accordingly, the width and length of the light field can be adjusted to a desired size by adjusting the focal lengths of the ellipse and parabola without adversely affecting the rectangular reflected image.

If the parabola is replaced by an arc with radius R, this circular ellipsoid can be represented, mathematically closed, as follows:

$$x = R \cdot \left(1 - \sqrt{1 - \frac{y^2}{R^2}}\right) + a \cdot \left(1 - \sqrt{1 - \frac{z^2}{b^2}}\right)$$

For $y << R$ is then $$x \approx \frac{y^2}{2R} + a \cdot \left(1 - \sqrt{1 - \frac{z^2}{b^2}}\right)$$

The circular ellipsoid thus again changes into a parabolic ellipsoid, whose parabola parameter is $p = R$. For very narrow reflectors with small width B, the parabola can thus be replaced by an arc. As a result, in certain production processes, advantages for the production of the shaping tool can result.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A reflector for dental and surgical operating room lighting fixtures which, in a spatial Cartesian coordinate system with axes x, y, z, in which x represents the optical axis of the reflector, has an elliptic shape in the plane $y=0$ and a parabolic shape in the plane $z=0$, with the parabolic shape having a focal point which coincides substantially with a closer focal point $f_1;0;0$ of the ellipse so that the latter defines a common focal point and light beams that come from the common focal point and strike the reflector in the planes $y=0$ and $z=0$, in a plane $x=f_2$ pass through a focal line $x=f_2$; $z=0$, the reflector being so constructed that, in the areas spaced from the optical axis $y=0$; $z=0$, the reflector includes distortions in the surface thereof so that light beams coming from the area of the common focal point and reflected outside planes $y=0$ and $z=0$ pass through the plane $x=f_2$ within a desired approximately rectangular light field and have distances from the focal line so that an essentially uniform light density is present in the light field; the shape of the reflector being determined by the equations:

$$x = \frac{y^2}{4 \cdot f_1} + \frac{f_1 + f_2}{2} \cdot \left(1 - \sqrt{1 - \frac{z^2}{f_1 \cdot f_2}}\right),$$

wherein:

$$\frac{\frac{f_1 + f_2}{2} = a; \text{ and } \sqrt{f_1 \cdot f_2} = b; 2 f_1 = p}{x = \frac{y^2}{2p} + a \cdot \left(1 - \sqrt{1 - \frac{z^2}{b^2}}\right)};$$

in which p is the parameter of the parabola $y=2px$ resulting in the plane $z=0$ and a and b are the large and the small semiaxis, respectively, of the ellipse resulting in the plane $y=0$.

2. A reflector according to claim 1 wherein a fine light-diffusing structure overlays the light-reflecting surface of the reflector to improve the uniformity of power density in the light field.

3. A reflector according to claim 1 wherein a coarse light-diffusing structure overlays the light-reflecting surface of the reflector to enlarge the width and height of the light field.

4. A reflector according to claim 1 wherein in the plane $y=0$ the reflector has a relatively small width and the parabola is approximated by an arc.

5. A reflector according to claim 1 wherein the focal point of the ellipse and the focal point of the parabola are spaced an insignificant distance from one another on the x axis, the distance corresponding to a desired width of the light field.

6. A reflector according to claim 1 wherein the focal point of the ellipse and the focal point of the parabola are spaced an insignificant distance from one another on the y axis, the distance corresponding to the desired length of the light field.

* * * * *